US006148737A

United States Patent [19]

Bowman et al.

[11] Patent Number: 6,148,737

[45] Date of Patent: Nov. 21, 2000

[54] DISPLAY SHELF

[76] Inventors: James H. Bowman; Linda M. Wildermuth, both of 152 Butternut Ct., Sinking Springs, Pa. 19608

[21] Appl. No.: 09/070,503

[22] Filed: Apr. 30, 1998

[51] Int. Cl.[7] ..... A47B 23/00

[52] U.S. Cl. ..... 108/42; 108/91; 222/192

[58] Field of Search ..... 108/42, 90, 91, 108/92, 93, 97; 222/192

[56] References Cited

U.S. PATENT DOCUMENTS

| | | | |
|---|---|---|---|
| 1,895,323 | 1/1933 | Hauf | 108/91 |
| 2,924,830 | 2/1960 | De Long | 108/91 X |
| 3,930,701 | 1/1976 | Otakie | 108/42 X |
| 4,713,949 | 12/1987 | Wilcox | 108/91 X |
| 4,846,076 | 7/1989 | Menges, Sr. et al. | 108/42 |
| 5,564,345 | 10/1996 | Crawford et al. | 108/91 |
| 5,568,772 | 10/1996 | Carson | 108/42 |
| 5,592,884 | 1/1997 | Glick et al. | 108/91 X |
| 5,669,312 | 9/1997 | Norton | 108/42 |
| 5,899,147 | 5/1999 | Clayton | 108/42 |

*Primary Examiner*—Jose V. Chen

[57] ABSTRACT

A new display shelf for resting objects on the top of a water bottle on a water cooler. The inventive device includes a platform designed for resting on the top of an inverted water bottle on a water cooler. The upper surface the platform has a lip upwardly extending therefrom along the outer perimeter of the platform. A number of stabilizing arms are downwardly depending from the lower surface of the platform. The stabilizing arms are designed for positioning adjacent the side of an inverted water bottle on which the platform is resting.

12 Claims, 2 Drawing Sheets

DISPLAY SHELF

BACKGROUND OF THE INVENTION

1. Field of the Invention

The present invention relates to accessories for water coolers and more particularly pertains to a new display shelf for resting objects on the top of a water bottle on a water cooler.

2. Description of the Prior Art

The use of accessories for water coolers is known in the prior art. More specifically, accessories for water coolers heretofore devised and utilized are known to consist basically of familiar, expected and obvious structural configurations, notwithstanding the myriad of designs encompassed by the crowded prior art which have been developed for the fulfillment of countless objectives and requirements.

Known prior art accessories for water coolers include U.S. Pat. No. Des. 355,316; U.S. Pat. Nos. 5,356,046; 4,834,250; EPO Patent No. EP 0 290 784 A1; PCT Patent No. WO 97/15212; U.S. Pat. Nos. 3,367,133; and 2,731,999.

While these devices fulfill their respective, particular objectives and requirements, the aforementioned patents do not disclose a new display shelf. The inventive device includes a platform designed for resting on the top of an inverted water bottle on a water cooler. The upper surface the platform has a lip upwardly extending therefrom along the outer perimeter of the platform. A number of stabilizing arms are downwardly depending from the lower surface of the platform. The stabilizing arms are designed for positioning adjacent the side of an inverted water bottle on which the platform is resting.

In these respects, the display shelf according to the present invention substantially departs from the conventional concepts and designs of the prior art, and in so doing provides an apparatus primarily developed for the purpose of resting objects on the top of a water bottle on a water cooler.

SUMMARY OF THE INVENTION

In view of the foregoing disadvantages inherent in the known types of accessories for water coolers now present in the prior art, the present invention provides a new display shelf construction wherein the same can be utilized for resting objects on the top of a water bottle on a water cooler.

The general purpose of the present invention, which will be described subsequently in greater detail, is to provide a new display shelf apparatus and method which has many of the advantages of the accessories for water coolers mentioned heretofore and many novel features that result in a new display shelf which is not anticipated, rendered obvious, suggested, or even implied by any of the prior art accessories for water coolers, either alone or in any combination thereof.

To attain this, the present invention generally comprises a platform designed for resting on the top of an inverted water bottle on a water cooler. The upper surface the platform has a lip upwardly extending therefrom along the outer perimeter of the platform. A number of stabilizing arms are downwardly depending from the lower surface of the platform. The stabilizing arms are designed for positioning adjacent the side of an inverted water bottle on which the platform is resting.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new display shelf apparatus and method which has many of the advantages of the accessories for water coolers mentioned heretofore and many novel features that result in a new display shelf which is not anticipated, rendered obvious, suggested, or even implied by any of the prior art accessories for water coolers, either alone or in any combination thereof.

It is another object of the present invention to provide a new display shelf which may be easily and efficiently manufactured and marketed.

It is a further object of the present invention to provide a new display shelf which is of a durable and reliable construction.

An even further object of the present invention is to provide a new display shelf which is susceptible of a low cost of manufacture with regard to both materials and labor, and which accordingly is then susceptible of low prices of sale to the consuming public, thereby making such display shelf economically available to the buying public.

Still yet another object of the present invention is to provide a new display shelf which provides in the apparatuses and methods of the prior art some of the advantages thereof, while simultaneously overcoming some of the disadvantages normally associated therewith.

Still another object of the present invention is to provide a new display shelf for resting objects on the top of a water bottle on a water cooler.

Yet another object of the present invention is to provide a new display shelf which includes a platform designed for resting on the top of an inverted water bottle on a water cooler. The upper surface the platform has a lip upwardly extending therefrom along the outer perimeter of the platform. A number of stabilizing arms are downwardly depending from the lower surface of the platform. The stabilizing arms are designed for positioning adjacent the side of an inverted water bottle on which the platform is resting.

Still yet another object of the present invention is to provide a new display shelf that may be used to hold objects such as flower pots and vases thereon, or more functional items relating to the water cooler such as cups and napkins thereon.

Even still another object of the present invention is to provide a new display shelf that provides a very stable surface on the top of an inverted water bottle on a water cooler for resting objects thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
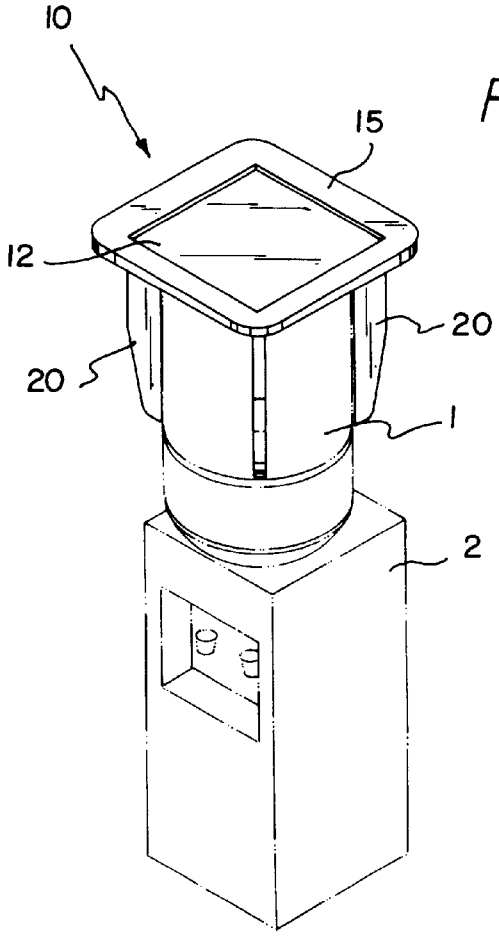
FIG. 1 is a schematic perspective view of a new display shelf in use resting on an inverted water bottle on a water cooler according to the present invention.
Figure 2:
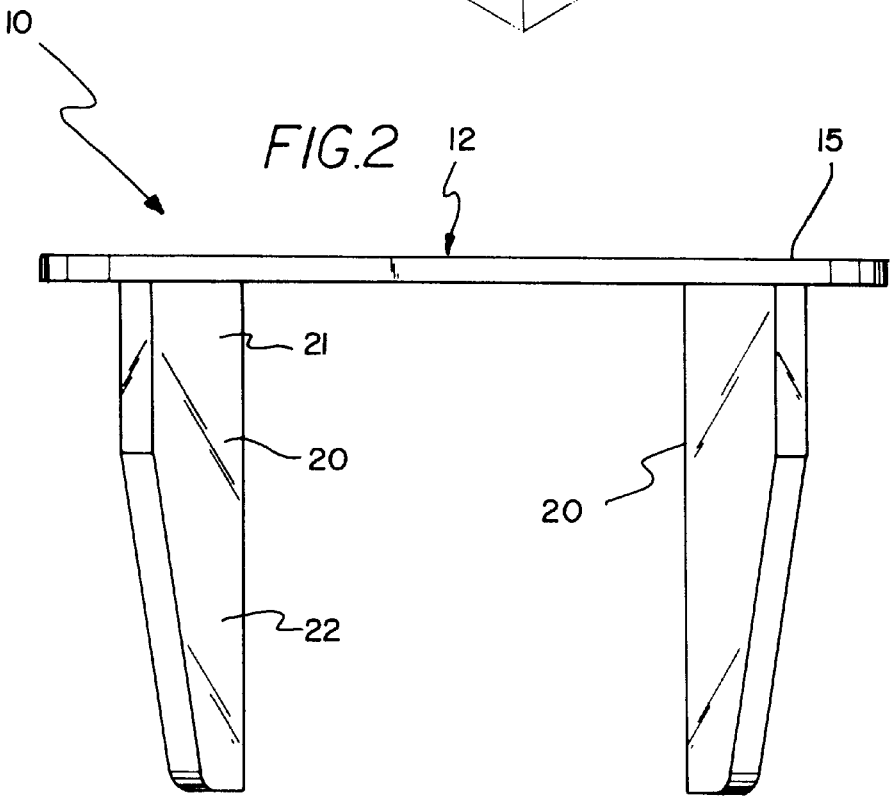
FIG. 2 is a schematic side view of the present invention.
Figure 3:
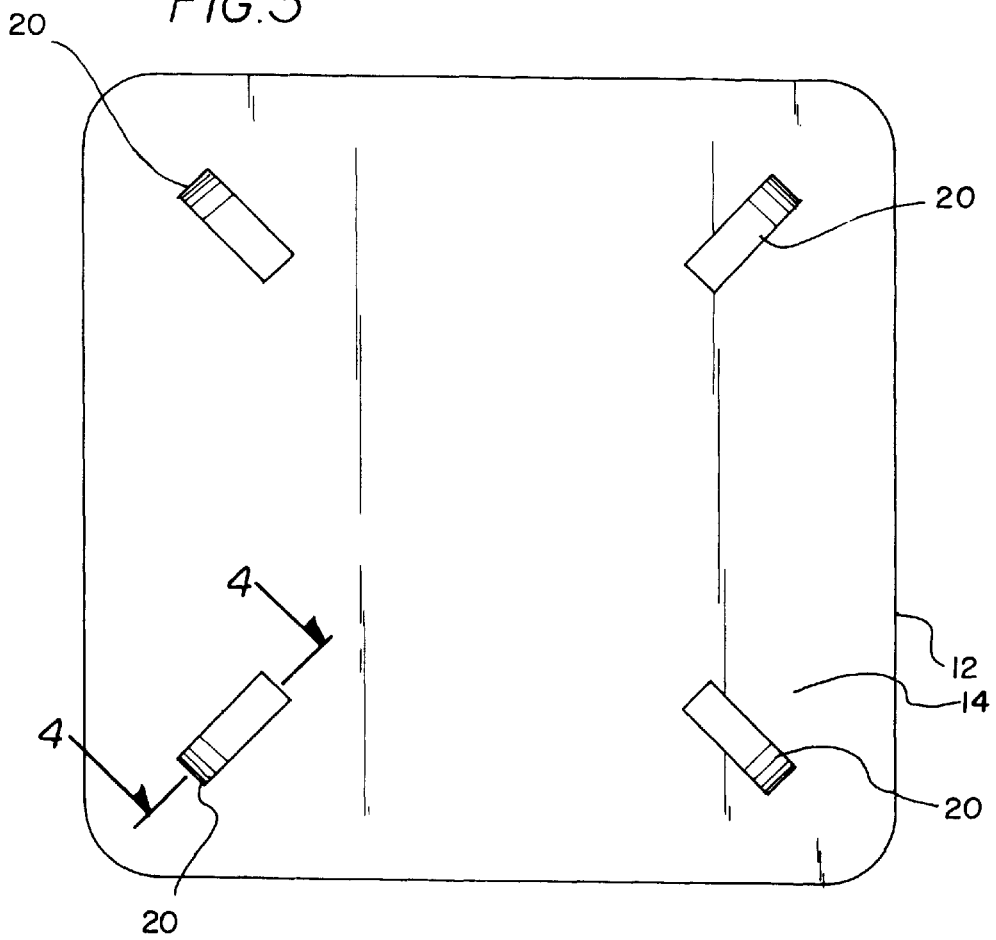
FIG. 3 is a schematic bottom plan view of the present invention.
Figure 4:
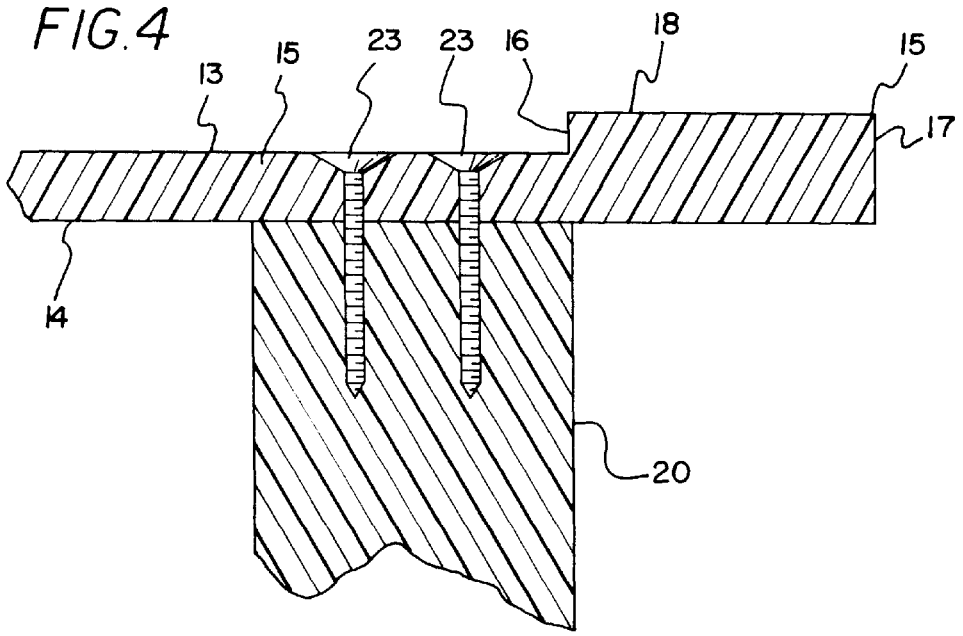
FIG. 4 is a schematic sectional view of the present invention taken from line 4—4 on FIG. 3.

With reference now to the drawings, and in particular to FIGS. 1 through 4 thereof, a new display shelf embodying the principles and concepts of the present invention and generally designated by the reference numeral 10 will be described.

In use, the shelf 10 is designed for resting on the top of an inverted generally cylindrical water bottle 1 on the top of a water cooler 2. Typically, the water bottle 1 has a cylinder length of about 17 inches and a diameter of about 11 inches. As best illustrated in FIGS. 1 through 4, the display shelf 10 generally comprises a platform 12 designed for resting on the top of an inverted water bottle 1 on a water cooler 2. The upper surface 13 the platform 12 has a lip 15 upwardly extending therefrom along the outer perimeter of the platform 12. A number of stabilizing arms 20 are downwardly depending from the lower surface 14 of the platform 12. The stabilizing arms 20 are designed for positioning adjacent the side of an inverted water bottle 1 on which the platform 12 is resting.

In closer, detail, the platform 12 is generally rectangular and ideally square as shown in the Figures. Optionally the platform may be a circular. The platform 12 has a center, an outer perimeter and substantially planar upper and lower surfaces 13,14. The platform 12 is designed for resting on the top of an inverted water bottle 1 on a water cooler 2. The upper surface 13 is designed for resting objects thereon. As illustrated in the Figures, the outer perimeter has four sides and four corners. Preferably, the corners of the outer perimeter of the platform 12 are rounded. The upper surface 13 the platform 12 has an annular lip 15 upwardly extending therefrom along the outer perimeter of the platform 12 the lip 15 has inner and outer edges 16,17 with the outer edge 17 of the lip 15 positioned adjacent the sides and corners of the of the outer perimeter of the platform 12. The inner edge 16 of the lip 15 defines a central region on the upper surface 13 of the platform 12 for resting objects thereon. The lip 15 also has a substantially planar top surface 18 that is parallel with the upper surface of the platform.

The platform 12 has a thickness defined between the upper and lower surfaces 13,14 of the platform 12. The lip 15 has a thickness defined between the upper surface 13 of the platform 12 and the top surface 18 of the lip 15. Preferably, the dimension of the thickness of the lip 15 is about equal to the dimension of the thickness of the platform 12. Even more preferably, the thickness of the platform 12 is greater than about ⅛ inch and ideally about ¼ inch to provide sufficient thickness to make the platform 12 rigid for supporting heavy objects thereon without bending. Preferably, the thickness of the lip 15 is greater than about ⅛ inch and ideally ¼ inch so that the total thickness of the platform 12 and the lip 15 is ideally about ½.

The platform 12 has a width defined between one pair of opposite sides of the outer perimeter of the platform 12. The platform 12 also has a length defined between another pair of opposite sides of the outer perimeter of the platform 12. Preferably, the dimension of the width and the dimension of the length of the platform 12 are about equal. Even more preferably, the width and the length of the platform 12 are both greater than about 11 inches such that the platform 12 extends beyond the diameter of most typical water cooler water bottles. Ideally the width and length of the platform 12 are both about 14.75 inches. Preferably, the lip 15 has a width defined between the inner and outer edges 16,17 of the lip 15. Preferably, the width of the lip 15 is between about ½ inch and about 4 inches. Ideally the width of the lip is about 2 inches.

A number of stabilizing arms 20 downwardly depend from the lower surface 14 of the platform 12 with a stabilizing arm positioned towards each of the corners of outer perimeter of the platform 12. The stabilizing arms 20 are designed for positioning adjacent the side of an inverted water bottle 1 on which the platform 12 is resting so that the stabilizing arms 20 provide stability to the platform 12 when resting on the top of the water bottle 1. Each of the stabilizing arms 20 is preferably positioned about equidistant from the center of the platform 12. Each of the stabilizing arms 20 is preferably coupled to the platform 12 by a pair of threaded fasteners 23. Each of the stabilizing arms 20 has a width and a thickness. In the preferred embodiment, the width of each of the stabilizing arms 20 is extended along a radiating line extending from the center of the platform 12 to the associated corner of the platform 12 the stabilizing arm is positioned adjacent to. Ideally, the thickness of each of the stabilizing arm 20 is about 0.75 inch while the width of each stabilizing arm 20 is about 2.25 inches.

Each stabilizing arm 20 preferably includes a generally rectangular upper portion 21 and a tapered lower portion 22 tapering away from the platform 12. Preferably, the dimension of the length of the upper portion 21 of each of the stabilizing arms 20 is less than about one-half the dimension of the overall length of the associated stabilizing arm 20. Ideally, the length of the upper portion is less than one-third the overall length of the stabilizing arm. It is preferred that the length of each of the stabilizing arms 20 is greater than about 1 inch to provide adequate stability to the platform 12 when resting on the top of an inverted water bottle 1. Even more preferably, the length of each of the stabilizing arms 20 is between 1 and 17 inches (which is about the typical length of the cylindrical portion of a water bottle 1). Ideally, the length of each stabilizing arm 20 is about 9.5 inches and the length of the upper portion 21 of each stabilizing arm 20 is about 3 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shelf for resting on the top of an inverted generally cylindrical water bottle on the top of a water cooler, said shelf comprising:

a platform having a center, an outer perimeter and substantially planar upper and lower surfaces;

said platform being adapted for resting on the top of an inverted water bottle on a water cooler;

said upper surface of said platform has a lip upwardly extending therefrom along said outer perimeter of said platform, said lip having inner and outer edges;

said inner edge of said lip defining a central region on said upper surface of said platform for resting objects thereon;

said lip having a substantially planar top surface;

wherein said platform has a thickness defined between said upper and lower surfaces of said platform;

wherein said lip has a thickness defined between said upper surface of said platform and said top surface of said lip;

a number of stabilizing arms being downwardly depending from said lower surface of said platform;

said stabilizing arms being adapted for positioning adjacent the side of an inverted water bottle on which said platform is resting;

each of said stabilizing arms being positioned about equidistant from said center of said platform; and each of said stabilizing arms having a width and a thickness, wherein said width of each of said stabilizing arms is extended along a line extending from said center of said platform such that said thickness of said stabilizing arm rests against a side of the water bottle for supporting said platform against the side of the water bottle.

2. The shelf of claim 1, wherein said platform is generally rectangular and said outer perimeter comprises four sides and four corners, and wherein a stabilizing arm is positioned toward each of said corners of outer perimeter of said platform.

3. The shelf of claim 2, wherein said platform has a width defined between one pair of opposite sides of said outer perimeter of said platform, wherein said platform has a length defined between another pair of opposite sides of said outer perimeter of said platform.

4. The shelf of claim 3, wherein the dimension of said width and the dimension of said length of said platform are about equal.

5. The shelf of claim 3, wherein said width and said length of said platform are both greater than about 11 inches.

6. The shelf of claim 1, wherein the dimension of said thickness of said lip is about equal to the dimension of said thickness of said platform.

7. The shelf of claim 1, wherein said thickness of said platform is greater than about ⅛ inch, and wherein said thickness of said lip is greater than about ⅛ inch.

8. The shelf of claim 1, wherein said lip has a width defined between said inner and outer edges of said lip, wherein said width of said lip is between about ½ inch and about 4 inches.

9. The shelf of claim 1, wherein each stabilizing arm has an upper portion and a tapered lower portion.

10. The shelf of claim 9, wherein each said stabilizing arm has a length, wherein said upper portion of each of said stabilizing arms has a length, and wherein the dimension of said length of said upper portion of each of said stabilizing arms being less than about one-half the dimension of the length of the associated stabilizing arm.

11. The shelf of claim 1, wherein each of said stabilizing arms has a length, wherein said length of each of said stabilizing arms is greater than about 1 inch.

12. A shelf for resting on the top of an inverted generally cylindrical water bottle on the top of a water cooler, said shelf comprising:

a platform being generally rectangular and having a center, an outer perimeter and substantially planar upper and lower surfaces, said outer perimeter comprising four sides and four corners;

said platform being adapted for resting on the top of an inverted water bottle on a water cooler, said upper surface being adapted for resting objects thereon;

wherein said corners of said outer perimeter of said platform are rounded;

said upper surface said platform has a lip upwardly extending therefrom along said outer perimeter of said platform, said lip having inner and outer edges, said outer edge of said lip being positioned adjacent said sides and corners of said of said outer perimeter of said platform;

said inner edge of said lip defining a central region on said upper surface of said platform for resting objects thereon;

said lip having a substantially planar top surface;

wherein said platform has a thickness defined between said upper and lower surfaces of said platform;

wherein said lip has a thickness defined between said upper surface of said platform and said top surface of said lip;

wherein the dimension of said thickness of said lip is about equal to the dimension of said thickness of said platform;

wherein said thickness of said platform is greater than about ⅛ inch;

wherein said thickness of said lip is greater than about ⅛ inch;

wherein said platform has a width defined between one pair of opposite sides of said outer perimeter of said platform;

wherein said platform has a length defined between another pair of opposite sides of said outer perimeter of said platform;

wherein the dimension of said width and the dimension of said length of said platform are about equal;

wherein said width and said length of said platform are both greater than about 11 inches such that said platform extends beyond the diameter of the water bottle;

wherein said lip has a width defined between said inner and outer edges of said lip, wherein said width of said lip is between about ½ inch and about 4 inches;

a number of stabilizing arms being downwardly depending from said lower surface of said platform, a stabilizing arm being positioned toward each of said corners of outer perimeter of said platform;

said stabilizing arms being adapted for positioning adjacent the side of an inverted water bottle on which said platform is resting;

each of said stabilizing arms being positioned about equidistant from said center of said platform;

each of said stabilizing arms being coupled to said platform by a pair of threaded fasteners;

each of said stabilizing arms having a width and a thickness, wherein said width of each of said stabilizing arms is extended along a line extending from said center of said platform to the associated corner of said platform such that said thickness of said stabilizing arm rests against a side of the water bottle for supporting said platform against the side of the water bottle;

each stabilizing arm having an upper portion and a tapered lower portion;

wherein each said stabilizing arm has a length, wherein said upper portion of each of said stabilizing arms has a length;

wherein the dimension of said length of said upper portion of each of said stabilizing arms being less than about one-half the dimension of the length of the associated stabilizing arm; and wherein said length of each of said stabilizing arms is greater than about 1 inch to provide adequate stability to said platform when resting on the top of the inverted water bottle.

* * * * *